US010046831B2

(12) United States Patent
McGarian

(10) Patent No.: US 10,046,831 B2
(45) Date of Patent: Aug. 14, 2018

(54) SECURITY DEVICE

(71) Applicant: Bruce McGarian, Stonehaven (GB)

(72) Inventor: Bruce McGarian, Stonehaven (GB)

( * ) Notice: Subject to any disclaimer, the term of this patent is extended or adjusted under 35 U.S.C. 154(b) by 0 days.

(21) Appl. No.: 15/125,068

(22) PCT Filed: Mar. 5, 2015

(86) PCT No.: PCT/GB2015/050641

§ 371 (c)(1),
(2) Date: Sep. 9, 2016

(87) PCT Pub. No.: WO2015/136244

PCT Pub. Date: Sep. 17, 2015

(65) Prior Publication Data

US 2017/0021899 A1 Jan. 26, 2017

(30) Foreign Application Priority Data

Mar. 10, 2014 (GB) ..... 1404192.5

(51) Int. Cl.

| | |
|---|---|
| ***B63B 17/04*** | (2006.01) |
| ***B63G 13/00*** | (2006.01) |
| ***F41H 11/08*** | (2006.01) |

(52) U.S. Cl.

CPC ..... *B63B 17/04* (2013.01); *B63G 13/00* (2013.01); *F41H 11/08* (2013.01); *B63B 2017/045* (2013.01)

(58) Field of Classification Search

CPC ... B63B 17/04; B63B 2017/045; B63B 45/08; F41H 11/08; E04H 17/00; B63G 13/00

See application file for complete search history.

(56) References Cited

FOREIGN PATENT DOCUMENTS

| | | | | | |
|---|---|---|---|---|---|
| CN | 201472648 U | * | 5/2010 | ..... | B63G 13/00 |
| JP | 2001191983 A | * | 7/2001 | ..... | B63G 13/00 |
| WO | WO-2013072704 A1 | * | 5/2013 | ..... | B63B 17/04 |

* cited by examiner

*Primary Examiner* — Anthony D Wiest

(74) *Attorney, Agent, or Firm* — Shook, Hardy & Bacon L.L.P.

(57) ABSTRACT

Security barrier comprising: a substantially planar support element (2) having top and bottom edges, wherein respective top and bottom first attachment sites are formed at the top and bottom edges; and a bulbous barrier element (9), which is separate from the support element, having top and a bottom edges and respective top and bottom second attachment sites formed at the top and bottom edges, with a curved protruding section extending between the top and bottom edges, the protruding section extending away from the plane containing the top and bottom edges, wherein the support element and the barrier element are releasably connected to each other by way of the first and second top and bottom attachment sites, so that the support element and barrier element define an internal space therebetween which receives a horizontal rail, and wherein the security barrier may rest on the rail, a vertical plane being defined between the rail and the surface, so that the rail lies at or near the top edge of the support element and of the barrier element, the support element extends close to the vertical plane, and the protruding section protrudes outwardly from the vertical plane.

20 Claims, 3 Drawing Sheets

SECURITY DEVICE

CROSS-REFERENCE TO RELATED APPLICATIONS

This application claims priority under 35 U.S.C. § 365 to PCT/GB2015/050641, filed on Mar. 5, 2015, entitled "A Security Device," and British Patent Application No. GP1404192.5, filed Mar. 10, 2014, entitled "A Security Device," the entirety of the aforementioned applications is incorporated by reference herein.

DESCRIPTION OF INVENTION

THIS INVENTION relates to a security device and in particular concerns a device for improving the security of a ship.

In recent years there have been several examples of commercial cargo ships being boarded by pirates. This type of event can present a serious threat to the wellbeing of the crew of the ship, as well as being commercially damaging.

It has been proposed to provide security barriers which can be placed over the rails of a ship to make it more difficult to board the ship. One example of a security barrier is shown in WO2013/072704. The barrier disclosed in this document comprises a bulbous head section which protrudes outwardly from the ship's rail. The head section is formed to be curved and smooth, and present an overhang to unwanted boarders approaching the security barrier from below. The aim of these security barriers is to make it more difficult to climb over the rail to gain access to the deck of the ship.

It is an object of the present invention to provide an improved security barrier of this type.

Accordingly, one aspect of the present invention provides a security barrier comprising: a substantially planar support element having a top edge and a bottom edge, wherein respective top and bottom first attachment sites are formed at the top and bottom edges; and a bulbous barrier element, which is separate from the support element, the barrier element having a top edge and a bottom edge and respective top and bottom second attachment sites formed at the top and bottom edges, with a curved protruding section extending between the top and bottom edges, the protruding section extending away from the plane containing the top and bottom edges, wherein the support element and the barrier element may be releasably connected to each other by way of the first and second top and bottom attachment sites, so that the support element and barrier element define an internal space therebetween which may receive a horizontal rail raised above a surface, and wherein the security barrier may be rested on the rail, a vertical plane being defined between the rail and the surface, so that the rail lies at or near the top edge of the support element and the top edge of the barrier element, the support element extends close to the vertical plane, and the protruding section protrudes outwardly from the vertical plane.

Advantageously, the security barrier further comprises an intermediate connector which connects to the first and second bottom attachment sites to allow the bottom edges of support element and the barrier element to be releasably attached together.

Preferably, the intermediate connector comprises an outward-facing trough shaped portion.

Conveniently, if the intermediate connector is omitted, the bottom edges of the support element and the barrier element may be releasably attached directly to each other.

Advantageously, the barrier element has a substantially symmetrical cross-sectional shape between the top and bottom edges thereof.

Preferably, a centreline is defined extending at right angles to the centre of the support element and, when the support element is attached to the barrier element, the point at which the barrier element protrudes furthest from the vertical plane is above the centreline.

Alternatively, a centreline is defined extending at right angles to the centre of the support element and, when the support element is attached to the barrier element, the point at which the barrier element protrudes furthest from the vertical plane is below the centreline.

Conveniently, the barrier element protrudes away from the plane containing the top and bottom edges over substantially the entirety of the distance between the top and bottom edges.

Advantageously, at least a part of the protruding section is spaced apart from the plane containing the top and bottom edges of the barrier element by at least 700 mm.

Preferably, a lower part of the protruding section subtends an angle of at least 15° from the plane containing the top and bottom edges of the barrier element.

Conveniently, one or both of the support element and the barrier element has a crooked portion formed at or near its top edge, the crooked portion defining a downward-facing trough into which the rail may be received.

Advantageously, the support element and barrier element are made from different materials.

Preferably, the support element is at least primarily made from a metal.

Conveniently, the barrier element is at least primarily made from a plastics, polymer or fibreglass material.

Another aspect of the present invention provides a method of installing a security barrier, the method comprising the steps of: providing a substantially planar support element having a top edge and a bottom edge, wherein respective top and bottom first attachment sites are formed at the top and bottom edges; and providing a bulbous barrier element, which is separate from the support element, the barrier element having a top edge and a bottom edge and respective top and bottom second attachment sites formed at the top and bottom edges, with a curved protruding section extending between the top and bottom edges, the protruding section extending away from the plane containing the top and bottom edges, releasably attaching the support element and the barrier element to each other by way of the first and second top and bottom attachment sites to form a security barrier, the support element and barrier element defining an internal space therebetween which may receive a horizontal rail; resting the security barrier on a rail which is raised above a surface, a vertical plane being defined between the rail and the surface, so that the rail lies at or near the top edge of the support element and the top edge of the barrier element, the support element extends close to the vertical plane, and the protruding section protrudes outwardly from the vertical plane.

Advantageously, the method further comprises the step of connecting the first and second bottom attachment sites to each other by way of an intermediate connector.

Preferably, the intermediate connector comprises an outward-facing trough shaped portion.

Conveniently, the surface has an upstanding kick plate formed thereon substantially directly under the rail, and wherein the trough portion fits over the kick plate.

Advantageously, the rail is the rail of a ship, and the surface is the deck of the ship.

Preferably, the rail is the top rail.

Alternatively, the rail is not the top rail.

Conveniently, the method further comprises the step of attaching the security barrier to the rail.

A further aspect of the present invention provides a ship having one or more security devices according to any one of the above positioned on a rail thereof.

Advantageously, substantially the entirety of the external rail or rails of the ship has security devices according to any one of the above positioned therealong, substantially adjacent to each other.

In order that the present invention may be more readily understood, embodiments thereof will now be described, by way of example, with reference to the accompanied drawings, in which:

FIGS. 1*a* and 1*b* show a first security barrier embodying the present invention;

FIG. 2 shows the first security barrier when installed;

FIGS. 3*a* and 3*b* show a second security barrier embodying the present invention;

Figure 1A:
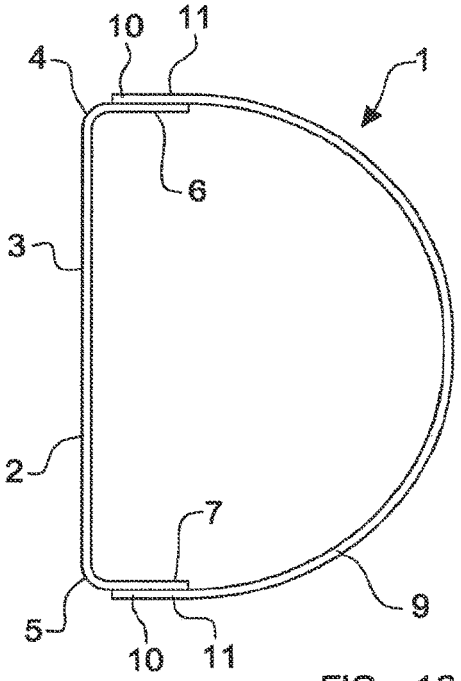
Figure 1B:
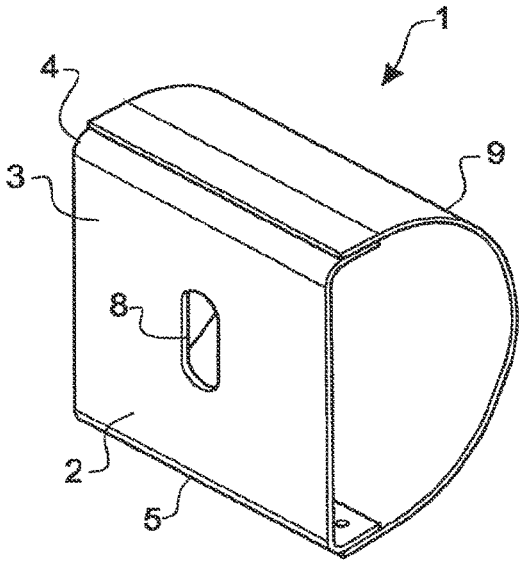

Referring firstly to FIGS. 1*a* and 1*b*, a first security barrier 1 embodying the present invention is shown. The first security barrier 1 comprises two main parts. Firstly, a support element 2 takes the form of a generally planar sheet 3 of material, which is rectangular in shape. At top and bottom edges 4,5 of the sheet 3 of material, the support element 2 is bent through approximately 90° to present upper and lower attachment plates 6, 7, which extend substantially at right angles to the plane of the sheet 3 of material. The attachment plates 6, 7 are preferably generally parallel with each other, and extend from the sheet 3 of material in the same direction.

The support element 2 is preferably formed from a robust material such as plastic or steel. Preferred embodiments of the support element 2 may be formed from a single sheet of material which is bent at its edges to form the upper and lower attachment plates 6, 7.

In the embodiment shown in FIGS. 1*a* and 1*b*, and aperture 8 is formed through the sheet 3 of material, approximately at the centre thereof. This aperture 8 may help to reduce overall weight of the support element 2, and also assist in attaching or anchoring the support element 2 to other components.

The first security barrier 1 also comprises a barrier element 9, which takes the form of a sheet of a robust material which is curved into an approximately semi-cylindrical shape.

At the free ends 10 of the generally semi-circular cross-sectional shape of the barrier element 9, substantially flat attachment regions 11 are formed.

The barrier element 9 is sized so that the attachment regions 11 thereof are spaced apart from one another by substantially the same distance as the attachment plates 6, 7 of the support element 2.

The width of the barrier element 9 is the same, or substantially the same, as that of the support element 2.

To assemble the first security barrier 1, the support element 2 and barrier element 9 are aligned so that the upper and lower attachment regions 11 of the barrier element 9 lie against the outer surfaces of the attachment plates 6, 7 of the support element 2. As can be seen in FIG. 1*a*, the resulting assembled security barrier 1 has a substantially "D"-shaped cross-sectional shape. The radius of curvature of the D-shape may be about 450 mm.

The assembled security barrier 1 preferably has a height of around 1-1.2 m, and a width of 1-1.5 m. The top rails provided on cargo ships are typically around 1-1.2 m high, and the security barrier 1 should be formed to be a suitable height to fit onto these rails.

The attachment regions 11 of the barrier element 9 and the attachment plates 6, 7 of the support element 2 have cooperating attachment sites, which allow these components to be releasably attached together.

For instance, apertures may be formed through the attachment regions 11 and attachment plates 6, 7, which are aligned when the security barrier 1 is assembled, and through which bolts may be passed.

In preferred embodiments, the securing element 2 is formed from a metal such as steel, and threaded apertures are formed through the attachment plates 6, 7 thereof, so that threaded bolts can be passed through the apertures.

The attachment regions 11 and attachment plates 6, 7 may also have cooperating location means, to help assemble the security barrier 1 correctly. For instance, the attachment plates 6, 7 may have outstanding protrusions such as bumps or ribs, and the inner surfaces of the attachment regions 11 may have corresponding dimples and/or indentations into which these protrusions can be received. As the components are assembled, these location sites will align and fit together, thus helping the security barrier 1 to be assembled correctly.

Figure 2:
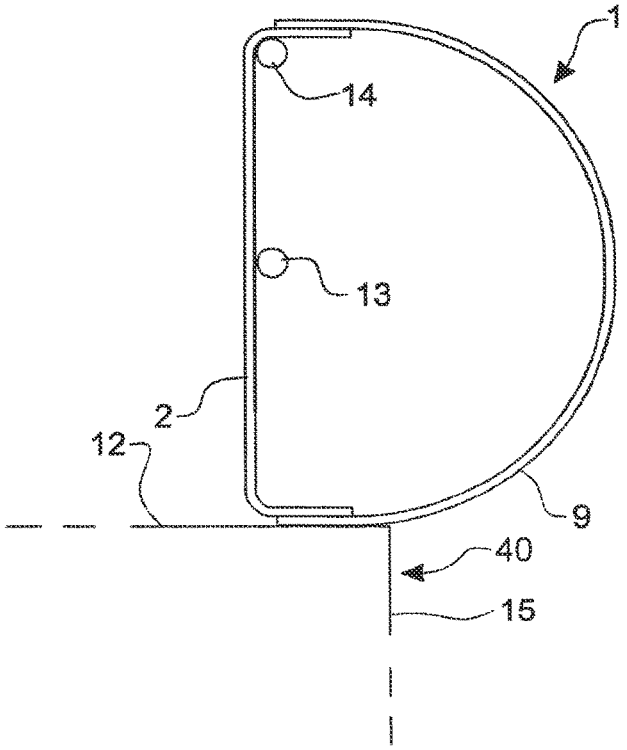

FIG. 2 shows the first security barrier 1 when installed and in position.

The deck 12 of a ship has railings near its outer edge 40, comprising a top rail 14 and an intermediate rail 13.

The first security barrier 1 is positioned so that the bulbous barrier element 9 faces outwardly, presenting an overhang with respect to the side wall 15 of the ship. The support element 2 is positioned substantially vertically, with its inner edge resting against the rear (i.e. inboard) sides of the top and intermediate rails 14, 13. The security barrier 1 rests on the deck 12, and is secured to the top and intermediate rails 14, 13 by any appropriate means, such as ropes or straps. The aperture 8 formed through the main sheet 3 of material of the support element 2 may allow improved access to the interior of the security barrier 1 during this process.

It is envisaged that, in order to install the first security barrier 1 in position, the lower attachment plate 7 of the support element 2 will firstly be attached to the lower attachment region 11 of the barrier element 9. The partially-assembled security barrier 1 can then be lifted onto the top rail 14, so that the top rail 14 lies in the corner between the main sheet of material 3 of the support element 2 and the lower attachment plate 7.

The security barrier 1 can then be rotated so that the support element 2 swings inward and downwardly towards the deck 12, until finally the security barrier 1 is in the position shown in FIG. 2.

The upper attachment plate 6 of the support element 2 can then be attached to the upper attachment region 11 of the barrier element 9 to complete the assembly of the security barrier 1.

A series of these security barriers 1 may be provided, adjacent to one another, running along the rail(s) of the ship. Preferably, all rails at the edge of the ship's deck are provided with security barriers.

It will be understood that one benefit of the first security barrier 1 is that, in transit and before installation, it will occupy significantly less space than the prior art device disclosed in WO2013/072704.

The device disclosed in this document is formed of a single piece, enclosing a significant quantity of empty space. In addition, if several of these devices are provided, there is no way for these devices to be stacked together.

By contrast, the first security barrier 1 discussed above can be dissembled into two component parts, thereby greatly increasing the flexibility and ease of storage. Moreover, if several devices are to be provided, the support elements 2 can be stacked together, as can the barrier elements 9. The easing cost of storage and transportation will therefore be significantly reduced.

The materials from which the support element 2 and/or barrier element 9 are formed may allow these components to flex sufficiently to facilitate stacking or nesting during storage and transportation.

Moreover, it is possible to form the two components from different materials. For instance, it may be desired to form the support element 2 from a metal such as steel, and the barrier element 9 from a lighter, more flexible material such as plastics.

Other materials that may be used for the support element 2 and/or barrier element 9 include copper, composite materials, fibreglass and polymer materials such as polyurethane, polypropylene and polyethylene. It is important that the materials are corrosion resistant, and also preferably resistant to sunlight.

The barrier element 9 may be provided with reinforcing ribs, which may be parallel and run vertically along all or part of the height of the barrier element 9. The ribs may alternatively be formed in diamond or square patterns, or in any other suitable configuration. The ribs may be provided on the outside surface and/or on the inside surface. Forming the ribs only on the inside surface may be preferable, as it will allow a smooth and featureless outer surface. The depth of the ribs may, for example, be 10-20 mm.

have one or more reinforcing elements integrally formed therewith, or attached thereto after production. The reinforcing elements may be formed from a different material to the main body of the barrier element 9 and may, for example, comprise metal (such as steel) strips or inserts.

The security barrier 1 is preferably open at its sides, with neither the support element 2 nor the barrier element 9 having side walls. This will assist in stacking the components for transportation and storage, and also means that, for vessels with several rails, it is more likely that lower rails (i.e. below the rail on which the security barrier 1 is rested) will be able to pass through the security barrier 1.

In other embodiments, however, side walls may be provided.

Figure 3A:
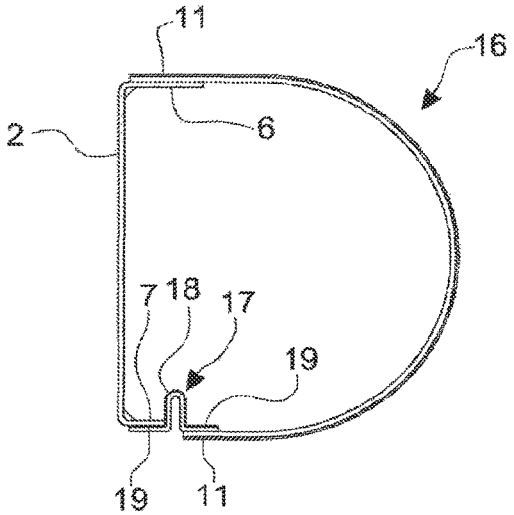
Figure 3B:
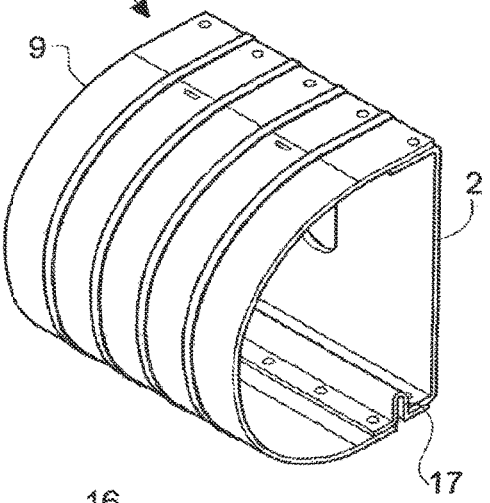

Referring to FIGS. 3*a* and 3*b*, a second security barrier 16 is shown.

In common with the first barrier device 1 as discussed above, the first security barrier 1 discussed above, the second security barrier 16 has a generally planar support element 2 and a bulbous barrier element 9.

However, the second security barrier 16 also has an intermediate connector 17. The intermediate connector 17 takes the form of an elongate strip, with a cross-sectional shape having a trough-shape 18 with attachment flanges 19 on either side. The intermediate connector 17 is of exactly or substantially the same width as the support element 2 and barrier element 9.

In use, a first one of the attachment flanges 19 is fixed to the lower attachment plate 7 of the support element 2, and the other of the attachment flanges 19 is attached to the lower support region 11 of the barrier element 9.

The lower attachment plate 7 and lower attachment region 11 are therefore not attached directly to one and another, but are attached to each other by means of the intermediate connector 17.

When the intermediate connector 17 is fixed in place the trough shape thereof faces outwardly.

Figure 4:
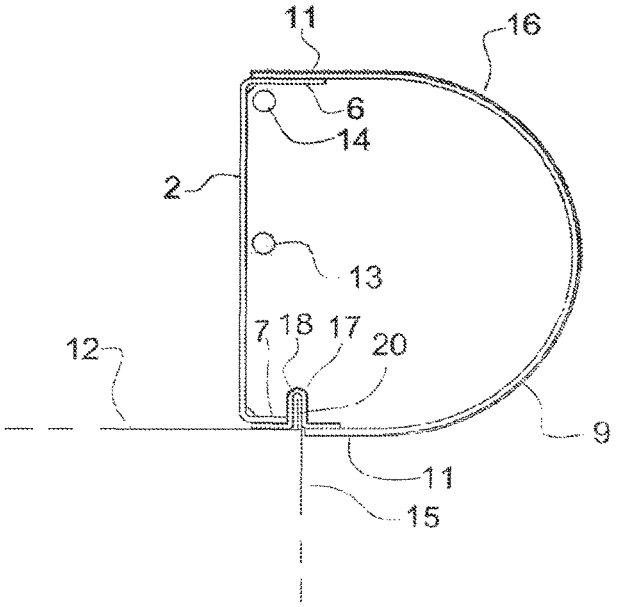
FIG. 4 shows the second security barrier when installed.

FIG. 4 shows the second security barrier 16 assembled and in place on the deck 12 of a ship.

The decks of many ships include a short upstanding kick plate which runs around the perimeter of the deck, at or near the edge thereof. The kick plate performs the function, among others, of preventing dropped objects from rolling off the deck of the ship. On typical vessels the kick plate may have a height of 100-150 mm. The deck 12 shown in FIG. 4 includes a kick plate 20. When the second security barrier 16 is in place, the kick plate 20 is received in the downward-facing trough formed by the intermediate connector 17. This helps to register the second security barrier 16 in place with respect to the deck 12, and also helps to prevent unwanted twisting/rotation of the second security barrier 16 with respect to the deck 12.

The second security barrier 16, is aside from this, fixed in place with respect to the upper and intermediate rails 14, 13 as described above in relation to the first security barrier 1.

In the embodiment shown in FIGS. 3*a*, 3*b* and 4, the upper attachment plate 6 of the support element 2 is wider than the lower attachment plate 7, to accommodate the lower intermediate connector 17.

In preferred embodiments the lower connection region 7 of the support element 2 can be attached directly to the lower support region 11 of the barrier element 9. This means that, if a kick plate 20 is present on the deck of a ship, the intermediate connector 17 can be used, to allow the security barrier 16 to fit over and register with the kick plate 20. However, in situations where no kick plate is present, the intermediate connector 17 can be omitted, and the support element 2 can be connected to the barrier element 9 at both its upper and lower edges, as shown in the example of FIGS. 1*a*, 1*b* and 2.

Figure 5:
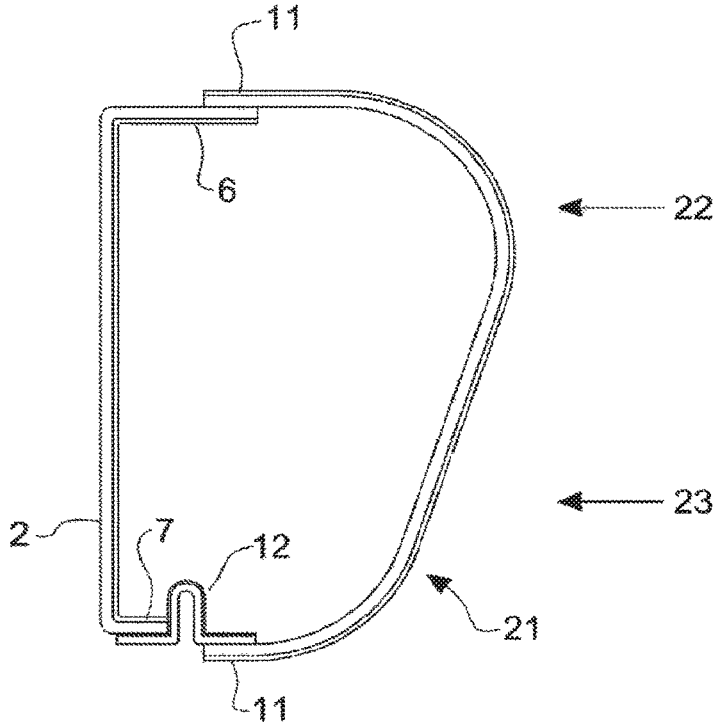
FIG. 5 shows a third security barrier embodying the present invention.

Turning to FIG. 5, an alternative barrier element 21 is shown, assembled with the support element 2 and the intermediate connector 17 as described above.

The barrier element 9 described above is (when it is attached to the support element 2) substantially symmetrical about a plane extending perpendicularly from the mid-point of the support element 2. The alternative barrier element 21 is asymmetric, however. When the alternative barrier element 21 is attached to a support element 2 as described above, the alternative barrier element 21 bulges out further from the plane of the support element 21 above the plane extending perpendicularly from the mid-point of the support element 2 than below this plane. In other words, when the alternative barrier element 21 is installed in place, an upper portion 22 thereof bulges outward more than a lower portion 23. This helps to present an overhang that is more difficult to climb over, as the overhang is effectively longer than is the case for the arrangements shown in FIGS. 1*a*, 1*b*, 2, 3*a*, 3*b* and 4.

Figure 6:
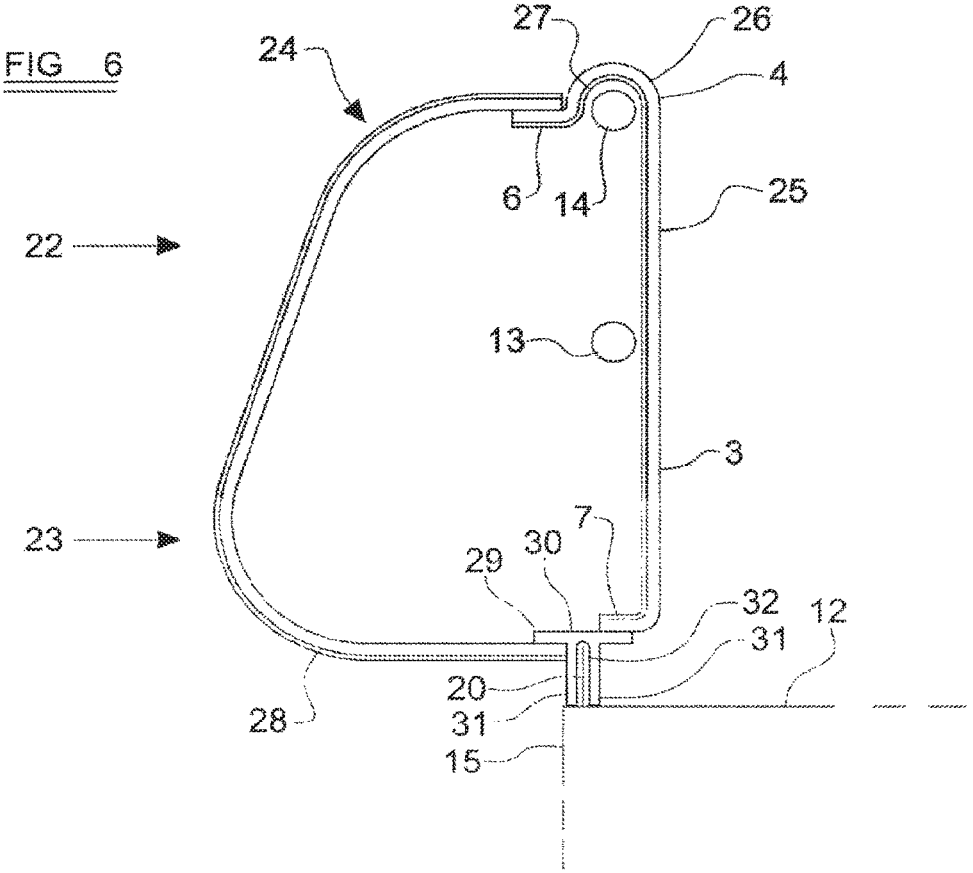
FIG. 6 shows a further security barrier embodying the present invention.

Turning to FIG. 6, a third security barrier 24 is shown. The third security barrier 24 includes an alternative support element 25, which is similar to the support element 2 described above, but instead of being bent through a right angle between the main sheet 3 of material and the upper support plate 6, has a crooked portion 26 where the upper edge 4 of the main sheet 3 of material meets the upper support plate 6. At this crooked portion 26, a downward-facing trough 27 is formed.

The third security barrier 24 also includes a further barrier element 28, which again is asymmetric, but is reversed with respect to the alternative barrier element 21 described above, in that a lower portion thereof bulges outward more than an upper portion. This will present a steeper overhang, and hence confer advantages with respect to a symmetrical barrier element 9 such as that described above.

In some embodiments a barrier element may be provided that can be releasably attached to the support element either way up, i.e. it can be installed so that the upper or lower portion bulges out further from the support element. This allows the resulting security barrier to be installed in either orientation, according to preference or to avoid interfering with existing components or equipment of the ship. It would also be possible to install some security barriers in one orientation and others in the other orientation. In this case it is envisaged that, wherein security barriers of opposite orientations are installed beside each other, a connecting piece may need to be provided to avoid presenting a hand-hold to unwanted boarders. The skilled reader will understand what form such a connecting piece may take.

FIG. 6 shows the third security barrier 24 when installed, and it can be seen that the upper rail 14 fits into the trough 27 formed by the crooked portion 26. This helps to maintain the third security barrier 24 in place, and also to prevent unwanted twisting or rotation of the third security barrier if large forces are exerted thereon.

The third security barrier 24 also has an alternative intermediate connector 29, positioned (as described above) between the lower attachment region 11 of the barrier element 28 and the lower attachment plate 7 of the support element 25. The alternative intermediate connector 29 takes the form of a plate 30, with a pair of parallel, spaced-apart ribs 31 protruding downwardly therefrom. A downward-facing trough 32 is formed between the ribs 31. When the third security barrier 24 is installed, as shown in FIG. 6, the kick plate 20 is received in this trough 32.

In preferred embodiments of the invention, when the security barrier is assembled the barrier element protrudes outwardly from the support element by a distance of at least 700 mm, and preferably more than 750 mm.

It is preferred that the angle of overhang of at least a region of the lower part of the barrier element is at least 15° from vertical when the security barrier is assembled. In embodiments of the invention the angle of overhand may be 25° or more.

In the embodiments described above, the security barriers rest on the upper rail of a ship's railings. In other embodiments, a security barrier may be provided that rests on a lower rail, and has a reduced overall height. A lower rail may be around 50%-75% of the height of the top rail. For instance, the height of the security barrier may be around 0.5-0.9 m. Security barriers of this type may be suitable for vessels (such as, for example, yachts) that are smaller than full-sized cargo ships.

It will be understood that embodiments of the invention provide effective security barriers that are easy to store and transport, and which will make it difficult or impossible to board a ship equipped with the security barriers.

In this specification terms such as "top", "bottom", "upper" and "lower" are used. It should be understood that these refer to the components when they assembled and installed in the manner described and depicted herein, and not in any other orientation.

The above description focuses on ships. However, it is also envisaged that the security barriers described above may be used with other oceangoing craft such as barges, hovercraft and catamarans. The security barriers may also be used in other situations where people may attempt to climb up and over a rail or wall. For instance, the security barriers may be used on oil rigs or other platforms.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A security barrier comprising:

a substantially planar support element having a top edge and a bottom edge, wherein respective top and bottom first attachment sites are formed at the top and bottom edges; and a bulbous barrier element, which is separate from the support element, the barrier element having a top edge and a bottom edge and respective top and bottom second attachment sites formed at the top and bottom edges, with a curved protruding section extending between the top and bottom edges, the protruding section extending away from the plane containing the top and bottom edges, wherein the support element and the barrier element is configured to be releasably connected to each other by way of the first and second top and bottom attachment sites, so that the support element and barrier element define an internal space therebetween which is configured to receive a horizontal rail raised above a surface, and wherein the security barrier is configured to be rested on the rail, a vertical plane being defined between the rail and the surface, so that the rail lies at or near the top edge of the support element and the top edge of the barrier element, the support element extends parallel to the vertical plane, and the protruding section protrudes outwardly from the vertical plane.

2. A security barrier according to claim 1, further comprising an intermediate connector which connects to the first and second bottom attachment sites to allow the bottom edges of support element and the barrier element to be releasably attached together.

3. A security barrier according to claim 2, wherein the intermediate connector comprises an outward-facing trough shaped portion.

4. A security barrier according to claim 2 wherein, if the intermediate connector is omitted, the bottom edges of the support element and the barrier element is configured to be releasably attached directly to each other.

5. A security barrier according to claim 1, wherein the barrier element has a substantially symmetrical cross-sectional shape between the top and bottom edges thereof.

6. A security barrier according to claim 1, wherein a centreline is defined extending at right angles to the centre of the support element and, when the support element is attached to the barrier element, the point at which the barrier element protrudes furthest from the vertical plane is above the centreline.

7. A security barrier according to claim 1, wherein a centreline is defined extending at right angles to the centre of the support element and, when the support element is attached to the barrier element, the point at which the barrier element protrudes furthest from the vertical plane is below the centreline.

8. A security barrier according to claim 1, wherein the barrier element protrudes away from the plane containing the top and bottom edges over substantially the entirety of the distance between the top and bottom edges.

9. A security barrier according to claim 1, wherein at least a part of the protruding section is spaced apart from the plane containing the top and bottom edges of the barrier element by at least 700 mm.

10. A security barrier according to claim 1, wherein one or both of the support element and the barrier element has a crooked portion formed at or near its top edge, the crooked portion defining a downward-facing trough into which the rail is configured to be received.

11. A security barrier according to claim 1, wherein the support element and barrier element are made from different materials.

12. A method of installing a security barrier, the method comprising the steps of:

providing a substantially planar support element having a top edge and a bottom edge, wherein respective top and bottom first attachment sites are formed at the top and bottom edges; and providing a bulbous barrier element, which is separate from the support element, the barrier element having a top edge and a bottom edge and respective top and bottom second attachment sites formed at the top and bottom edges, with a curved protruding section extending between the top and bottom edges, the protruding section extending away from the plane containing the top and bottom edges, releasably attaching the support element and the barrier element to each other by way of the first and second top and bottom attachment sites to form a security barrier, the support element and barrier element defining an internal space therebetween which is configured to receive a horizontal rail;

resting the security barrier on a rail which is raised above a surface, a vertical plane being defined between the rail and the surface, so that the rail lies at or near the top edge of the support element and the top edge of the barrier element, the support element extends parallel to the vertical plane, and the protruding section protrudes outwardly from the vertical plane.

13. A method according to claim 12, further comprising the step of connecting the first and second bottom attachment sites to each other by way of an intermediate connector.

14. A method according to claim 13, wherein the intermediate connector comprises an outward-facing trough shaped portion.

15. A method according to claim 14, wherein the surface has an upstanding kick plate formed thereon substantially directly under the rail, and wherein the trough portion fits over the kick plate.

16. A method according to claim 12, wherein the rail is the rail of a ship, and the surface is the deck of the ship.

17. A method according to claim 16, wherein the rail is the top rail.

18. A method according to claim 12, further comprising the step of attaching the security barrier to the rail.

19. A ship having one or more security positioned on a rail thereof, each of the one or more security devices comprising:

a substantially planar support element having a top edge and a bottom edge, wherein respective top and bottom first attachment sites are formed at the top and bottom edges; and a bulbous barrier element, which is separate from the support element, the barrier element having a top edge and a bottom edge and respective top and bottom second attachment sites formed at the top and bottom edges, with a curved protruding section extending between the top and bottom edges, the protruding section extending away from the plane containing the top and bottom edges, wherein the support element and the barrier element may be releasably connected to each other by way of the first and second top and bottom attachment sites, so that the support element and barrier element define an internal space therebetween which may receive a horizontal rail raised above a surface, and wherein the security device may be rested on the rail, a vertical plane being defined between the rail and the surface, so that the rail lies at or near the top edge of the support element and the top edge of the barrier element, the support element extends parallel to the vertical plane, and the protruding section protrudes outwardly from the vertical plane.

20. A ship according to claim 19, wherein substantially the entirety of the external rail or rails of the ship have the security devices positioned therealong, substantially adjacent to each other.

* * * * *